US005494017A

United States Patent [19]

Miyata et al.

[11] Patent Number: 5,494,017

[45] Date of Patent: Feb. 27, 1996

[54] IGNITION CONTROL APPARATUS AND METHOD FOR A MULTI-CYLINDER TWO CYCLE ENGINE

[75] Inventors: Mitsuru Miyata; Tomoyuki Hirose, both of Atsugi, Japan

[73] Assignee: Unisia Jecs Corporation, Atsugi, Japan

[21] Appl. No.: 246,237

[22] Filed: May 19, 1994

[30] Foreign Application Priority Data

May 19, 1993 [JP] Japan ..... 5-117161
Jun. 7, 1993 [JP] Japan ..... 5-136282

[51] Int. Cl.[6] ..... F02P 9/00; F02P 11/00

[52] U.S. Cl. ..... 123/414; 123/643

[58] Field of Search ..... 123/414, 479, 123/630, 643

[56] References Cited

U.S. PATENT DOCUMENTS 4,471,739 9/1984 Yamato et al. ..... 123/479
4,476,830 10/1984 Hasegawa et al. ..... 123/479
4,485,784 12/1984 Fujii et al. ..... 123/414 X
4,494,518 1/1985 Katayama et al. ..... 123/414 X
4,658,786 4/1987 Foss et al. ..... 123/414
4,664,082 5/1987 Suzuki ..... 123/414

*Primary Examiner*—Tony M. Argenbright
*Attorney, Agent, or Firm*—Foley & Lardner

[57] ABSTRACT

A reference angle signal which provides a reference for ignition control of each cylinder is output together with a cylinder discrimination signal for matching the reference angle signal with the respective cylinder, and ignition control carried out for separate cylinders on the basis of the cylinder discrimination results from the cylinder discrimination signal. When there is an abnormality in the cylinder discrimination signal and cylinder judgment becomes nonfunctional, the reference angle signal is matched with the respective cylinder in the ignition order under the normal conditions up until the occurrence of the abnormality, and ignition is carried out normally in the separate cylinders. As a result, even if cylinder discrimination by the cylinder discrimination signal becomes nonfunctional, ignition for separate cylinders can be continued, so that the engine can keep running.

12 Claims, 7 Drawing Sheets

IGNITION CONTROL APPARATUS AND METHOD FOR A MULTI-CYLINDER TWO CYCLE ENGINE

FIELD OF THE INVENTION

The present invention relates to an apparatus and method for controlling the ignition of a multi-cylinder two cycle engine, and in particular an ignition control apparatus and method wherein a reference angle signal which provides a reference for measuring ignition timing, is matched with respective cylinders on the basis of a cylinder discrimination signal, to thus cause ignition in each cylinder.

DESCRIPTION OF THE RELATED ART

Conventionally with electronic distributor type ignition controllers for multi-cylinder two cycle engines, a reference angle signal which provides a reference for ignition control of each separate cylinder, is output for each predetermined crank angle position together with a cylinder discrimination signal for matching the reference angle signal with a respective cylinder. The reference angle signal is then matched with the respective cylinder on the basis of the cylinder discrimination signal to thus discriminate a cylinder to the ignited, while the ignition timing is measured with reference to the reference angle signal, to thus cause ignition in the discriminated cylinder.

More specifically, in the case of a three cylinder two cycle engine for example, a reference angle signal REF is output for each predetermined crank angle before TDC (top dead center) of each cylinder at intervals of 120 crank angle degrees, and a cylinder discrimination signal CYL having different numbers of pulses is output between the reference angle signals REF - REF. For example, when the number of pulses of the cylinder discrimination signal CYL occurring between the reference angle signals REF - REF is "1" cylinder #1 is discriminated, when the number is "0" cylinder #2 is discriminated, while when the number is "2" cylinder #3 is discriminated.

The cylinder to be ignited is discriminated for each input of the reference angle signal REF from the number of pulses of the immediately prior cylinder discrimination signal CYL, while the ignition timing which is determined by the engine operating conditions, is measured with reference to the reference angle signal REF. An ignition signal is then output at the ignition timing to the power transistor of the ignition coil of the cylinder to be ignited to thus carry out ignition by a spark plug.

With the above construction wherein ignition control is carried out by matching the reference angle signal REF each time to the respective cylinder on the basis of the cylinder discrimination signal CYL to thus discriminate the cylinder to be ignited, when an abnormality such as for example the loss of the cylinder discrimination signal CYL occurs, cylinder discrimination becomes nonfunctional. As a result in correlation of the number of pulses with the cylinders, since the number of pulses between the reference angle signals REF - REF is continuously detected as a "0", all the reference angle signals REF are matched to the #2 cylinder, so that ignition is only carried out in that cylinder, resulting in engine stall.

SUMMARY OF THE INVENTION

In view of the above mentioned problems, it is an object of the present invention to provide an apparatus and method for controlling the ignition of a multi-cylinder two cycle engine whereby ignition at a desired ignition timing for each cylinder is possible even in the event of an abnormality occurring in the cylinder discrimination signal during ignition control of the respective separate cylinder, so that the engine will keep running.

It is a further object of the present invention to provide an apparatus and method for controlling ignition whereby ignition control is possible without difficulty in engine starting at the time of restarting, even in the event of an abnormality occurring in the cylinder discrimination signal.

To achieve the above objectives, the apparatus and method for controlling the ignition of a multi-cylinder two cycle engine according to the present invention comprises; means for outputting for each predetermined crank angle position, a reference angle signal which provides a reference for ignition control of each separate cylinder, and means for outputting a cylinder discrimination signal for matching the reference angle signal with the respective cylinders. The construction is such that when the cylinder discrimination signal is output normally, the reference angle signal is matched with the respective cylinder on the basis of the cylinder discrimination signal, and the ignition timing is measured with reference to the reference angle signal, to thus carry out ignition in the respective separate cylinders. On the other hand, when an abnormality occurs in the cylinder discrimination signal, the reference angle signal is matched with the respective cylinder in the order in which each reference signal was matched with the respective cylinder under the normal conditions up until the occurrence of the abnormality, and the ignition timing is measured with reference to the reference angle signal, to thus carry out ignition in the respective separate cylinders.

With such a construction, when the cylinder discrimination signal is output normally, the reference angle signal is matched with the respective cylinder on the basis of the cylinder discrimination signal, and ignition of the respective separate cylinders is controlled using the reference angle signal as a reference for measuring ignition timing. However, even in the event of an abnormality in the cylinder discrimination signal, ignition of each separate cylinder can be carried out the same way as under normal operation by matching the reference angle signals with the respective cylinders in the order in which each reference angle signal was matched with the respective cylinder under normal operation.

The construction may preferably be such that when the cylinder discrimination signal is being output normally, a counter value is increased to a predetermined value on the basis of the cylinder discrimination result from the cylinder discrimination signal, while when an abnormality in the cylinder discrimination signal output occurs, the counter value is increased for each generation of the reference angle signal, and cylinder discrimination is carried out based on the counter value.

With such a construction wherein the counter value is increased according to the cylinder discrimination result when the cylinder discrimination signal is being output normally, then even if cylinder discrimination is not carried out by the cylinder discrimination signal due for example to an abnormality in the cylinder discrimination signal, cylinder discrimination can be easily achieved from the count value by increasing the counter value for each generation of the reference angle signal.

The construction may preferably be such that the cylinder discrimination signal denotes the cylinder number by the number of pulses generated at the intervals of generation of the reference angle signals.

In this case, by counting the number of pulses of the cylinder discrimination signal at the intervals of generation of the reference angle signals, the cylinder number denoted by the number of pulses can be specified from a previously set correlation between the number of pulses and the cylinder number. The reference angle signal can thus be matched with the respective cylinder.

Furthermore the construction may be such that determination of whether or not the cylinder discrimination signal is being output normally, involves a comparison between the latest and previous cylinder discrimination results from the cylinder discrimination signal.

With such a construction, the previous and latest cylinder discrimination results should correspond to the ignition order if the cylinder discrimination signal is being output normally. If the previous and latest cylinder discrimination results are the same, or the cylinder discrimination result to be expected from the previous cylinder discrimination result does not agree with the latest cylinder discrimination result, then it can be judged that some kind of abnormality in the cylinder discrimination signal has occurred.

Moreover, the construction may be such that the latest discrimination result for normal output of the cylinder discrimination signal or for when some kind of abnormality has occurred, are kept stored even after the engine stops, and when the discrimination result read immediately before starting the engine is abnormal, the ignition timing is measured with reference to the reference angle signal, and ignition is carried out simultaneously in all cylinders.

With the present invention, when some kind of abnormality occurs in the cylinder discrimination signal so that accurate cylinder discrimination using the cylinder discrimination signal is not possible, then ignition control of the separate cylinders is carried out as for normal conditions in accordance with the order up until the occurrence of the abnormality. However, once the engine has stopped, then even though the next cylinder to be ignited is recorded, if for example the engine rotates while stopped, there is a possibility of a change in the cylinder which should be first ignited. Hence it is no longer possible to carry out expected ignition control for the separate cylinders at the time of restart. In this case when the engine stops with the cylinder discrimination signal in the abnormal condition, then by carrying out ignition for all of the cylinders simultaneously at the time of restart, then this can at least ensure that ignition is carried out at the expected ignition timing. Consequently restart can be reliably carried out, even when cylinder discrimination is not carried out using the cylinder discrimination signal.

Here when carrying out simultaneous ignition of all cylinders, it is preferable to limit the advance angle control of the ignition timing, compared to that for the ignition timing control range at the time of ignition in separate cylinders.

That is to say, with simultaneous ignition in all cylinders, ignition is carried out even in those cylinders wherein it does not correspond to the actual ignition timing. Consequently the advance setting is limited to prevent at least ignition in the cylinder in which combustion is occurring, so that influence on cylinders other than the cylinder to be ignited can be minimized.

Further objects and aspects of the present invention will become apparent from the following description of embodiments given in conjunction with the accompanying drawings.

DETAILED DESCRIPTION OF THE PREFERRED EMBODIMENTS

Figure 1:
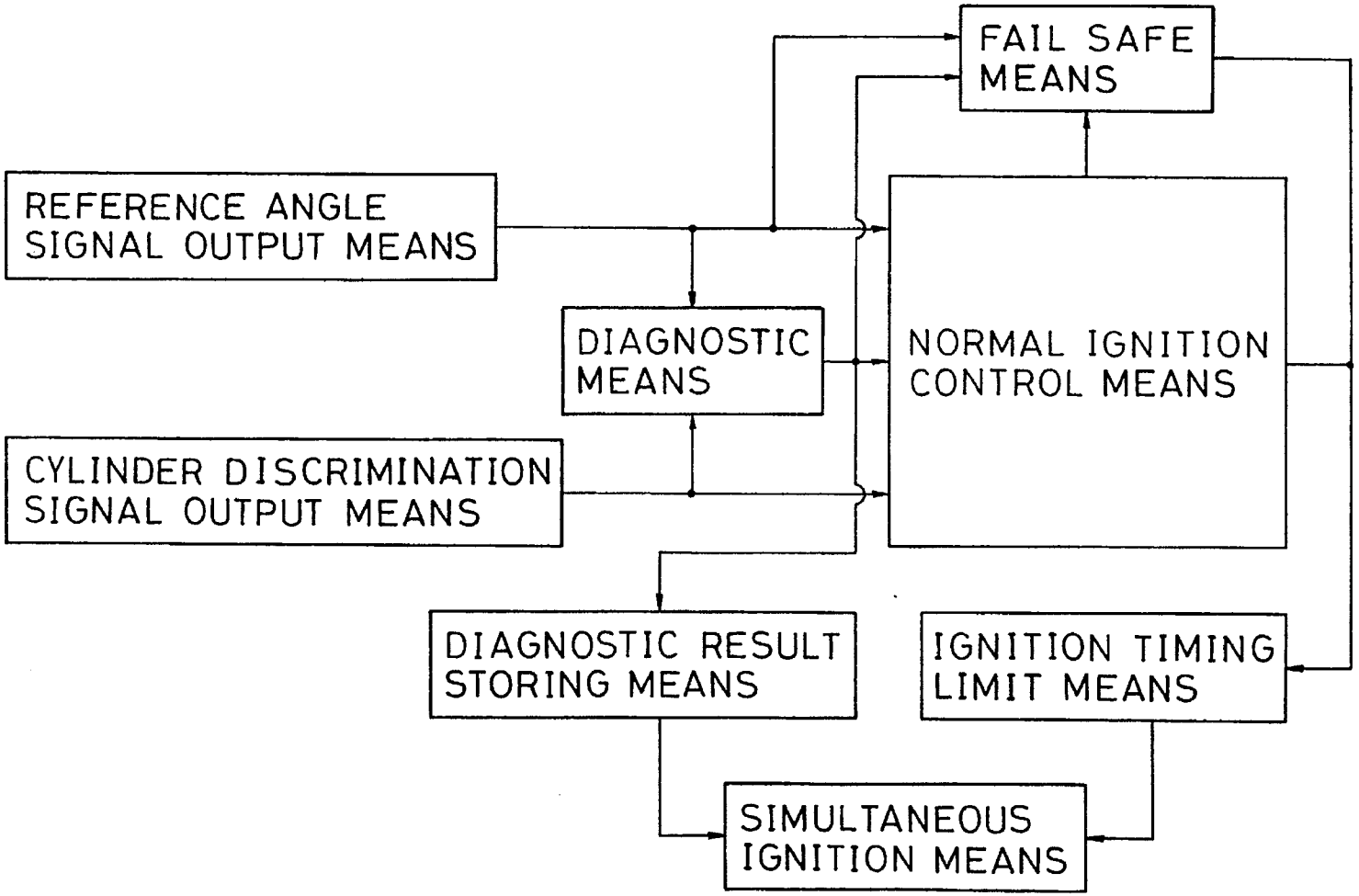
FIG. 1 is a block diagram illustrating a basic structure of an ignition control apparatus according to the present invention.

FIG. 2 through FIG. 7, illustrate embodiments of an ignition control apparatus and method for a multi-cylinder two cycle engine according to the present invention. A basic structure of the ignition control apparatus of the present invention is shown in FIG. 1.

Figure 2:
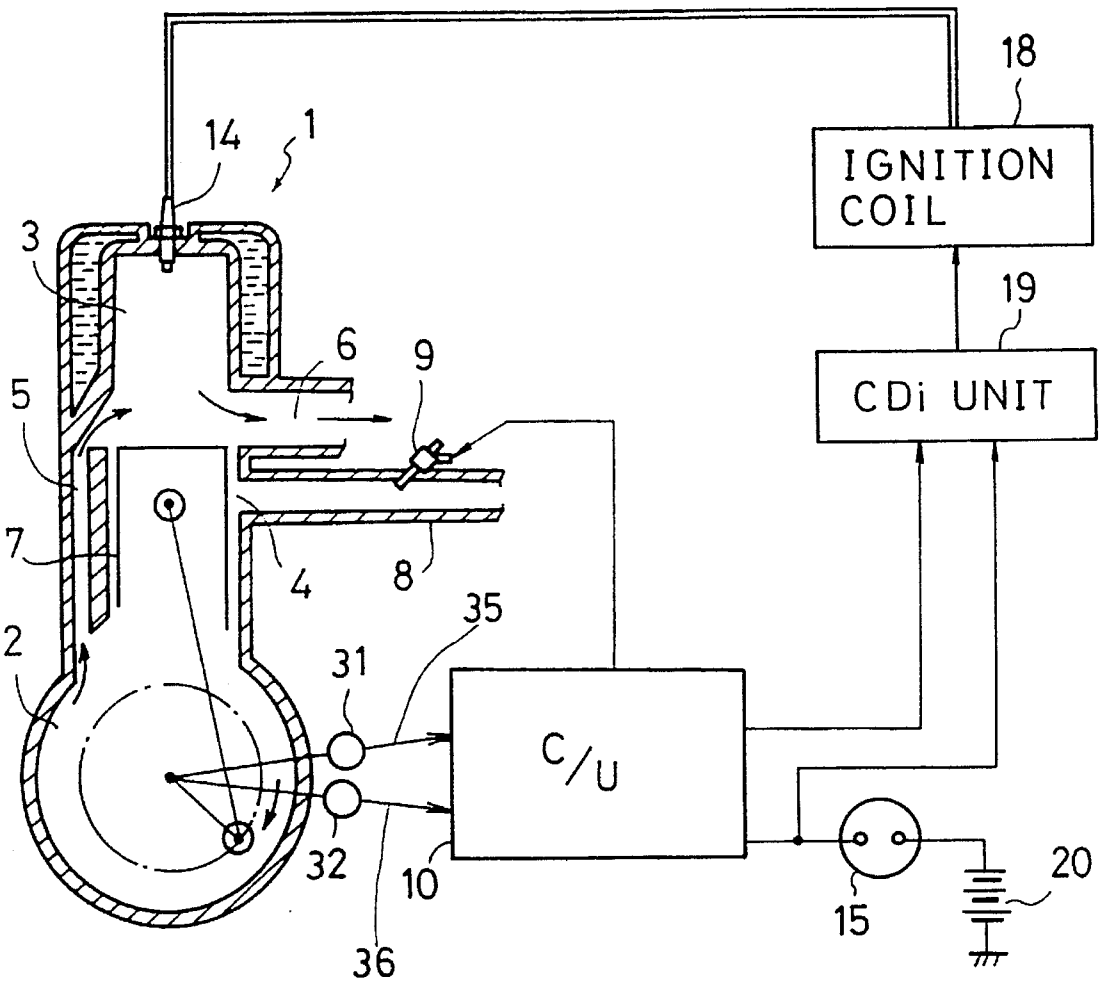
FIG. 2 is a schematic system diagram illustrating a system structure of embodiments of the present invention.

As shown in FIG. 2 which illustrates a system structure of the embodiments, a three cylinder two cycle engine 1 is provided with an intake port 4, a scavenging port 5, and an exhaust port 6 in the wall of each cylinder. During the compression stroke, a mixture is drawn into the crankcase 2 via the intake port 4 due to a low pressure produced below the piston 7, and when the piston 7 passes through the exhaust port 6 on completion of the work stroke, the combustion gas in the cylinder 3 is discharged through the exhaust port 6. With further downward movement of the piston 7, the scavenging port 5 communicates with the crankcase 2 so that the mixture compressed in the crankcase 2 scavenges the exhaust gas as it flows into the cylinder 3.

An electromagnetic type fuel injection valve 9 is provided in an intake path 8 connected to the intake port 4 so that a mixture produced by fuel injected and supplied from the fuel injection valve 9, flows into the crankcase 2 from the intake port 4.

The fuel injection valve 9 is opened by a valve open drive signal sent from a control unit 10 having a microcomputer, to thus inject and supply fuel which has been regulated to a predetermined pressure. The fuel injection supply amount is controlled by the opening time of the fuel injection valve 9.

A reference angle signal REF 35 which provides a reference for measuring the ignition timing for each cylinder, is input for each predetermined crank angle position, to the control unit 10 from a first crank angle sensor 31 (reference angle signal output means) attached to the crankshaft. Furthermore, a cylinder discrimination signal CYL 36 for matching the reference angle signal REF with the respective cylinder, is input to the control unit 10 from a second crank angle sensor 32 (cylinder discrimination signal output means) attached to the crankshaft.

Figure 4:
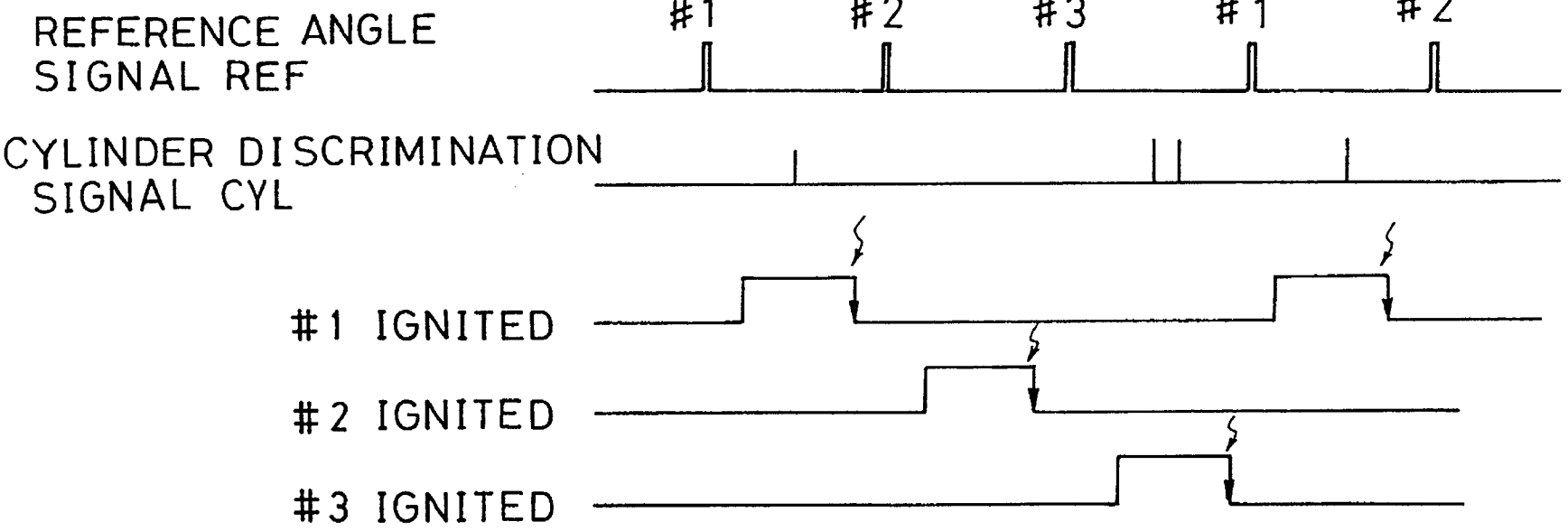
FIG. 4 is a time chart illustrating characteristics of a cylinder discrimination signal used in the embodiments.

The present embodiment is constructed so that the reference angle signal REF and the cylinder discrimination signal CYL are output according to the timing shown in FIG. 4, and cylinder discrimination is carried out by the number of pulses (3 pulse number types, namely "0", "1", "2") of the cylinder discrimination signal CYL generated in the interval between the outputs of the reference angle signals REF.

A spark plug 14 and ignition coil 18 (incorporating a power transistor) are provided for each cylinder of the engine 1. The ignition timing for each cylinder is controlled by ON/OFF control of the power transistor by an ignition signal from the control unit 10 via a CDi unit 19.

Voltage from a battery 20 is applied to the control unit 10 via an ignition switch 15.

As follows is a description in accordance with the flow chart of FIG. 3, of a first embodiment of an ignition control incorporated in the control unit 10 and using the reference angle signal REF and the cylinder discrimination signal CYL.

Figure 3:
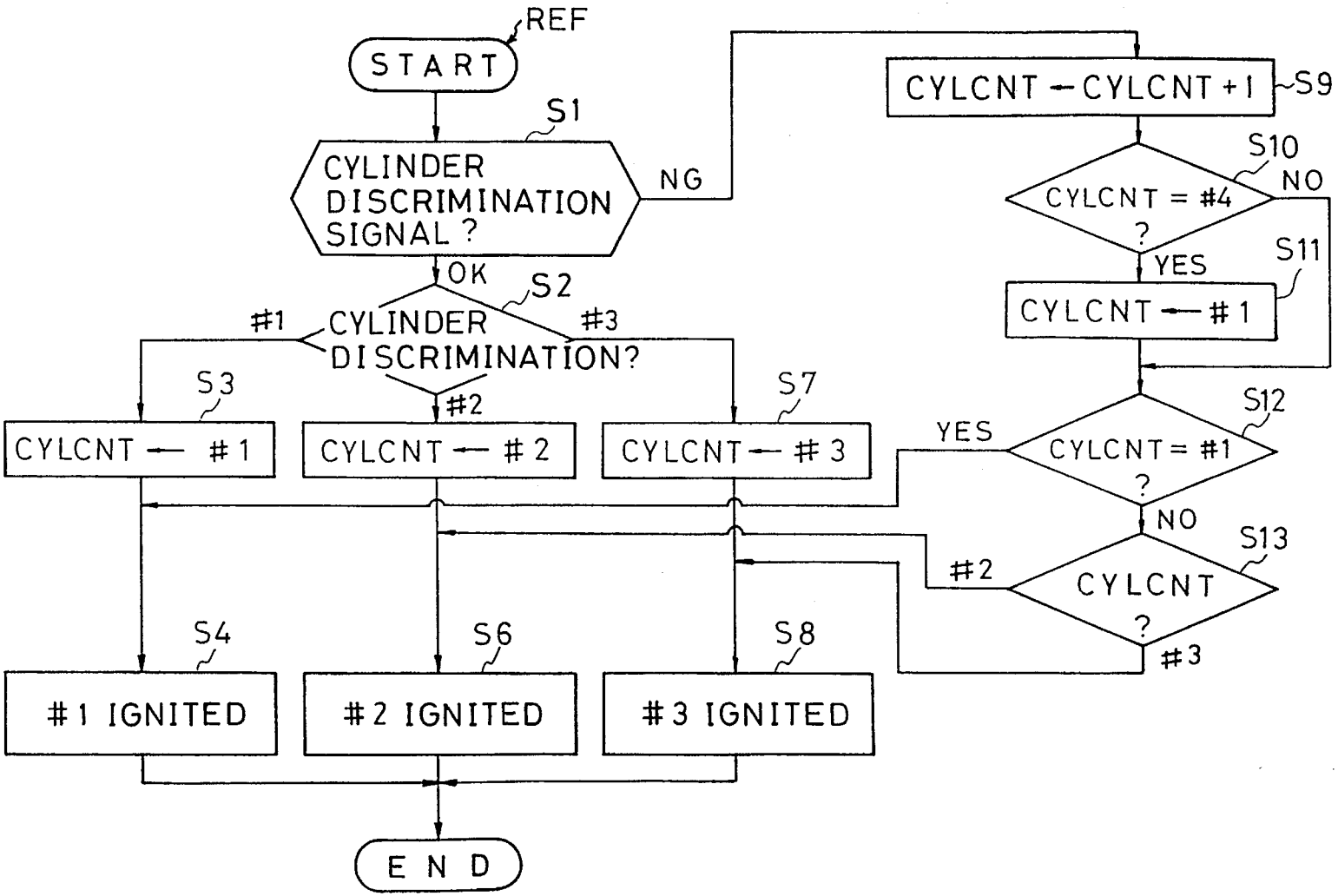
FIG. 3 is a flow chart illustrating an ignition control according to a first embodiment.

In this embodiment, the functions of a diagnostic means, a normal ignition control means, and a fail safe means as shown in FIG. 1 are provided by the control unit 10 in the form of software as illustrated by the flow chart of FIG. 3.

In the flow chart of FIG. 3, initially in step 1, (with "step" denoted by S in the figures) diagnosis is made to determine if the cylinder discrimination signal CYL is being output normally.

More specifically, the number of pulses output from the second crank angle sensor 32, between the reference angle signals REF are counted, and an abnormality is diagnosed when the count results for the previous count and current count are the same, or when the number of pulses expected from the previous count result are not counted within the current count interval.

Then in step 1, when judged that the cylinder discrimination signal CYL is being output normally, control proceeds to step 2, and a cylinder for which the latest reference angle signal REF is the ignition control reference is specified on the basis of the count result for the number of pulses occurring between the reference angle signals REF. With the three cylinder two cycle engine of the present embodiment, the ignition order is #1 cylinder→#2 cylinder→#3 cylinder.

When judged in step 2 that the ignition reference timing is for the #1 cylinder, control proceeds to step 3 where a #1 is set in an ignition cylinder counter CYLCNT. Control then proceeds on to step 4 where an ignition signal with the current reference angle signal REF as the reference timing, is output to the power transistor of the #1 cylinder to cause ignition therein.

Similarly, when judged in step 2 that the ignition reference timing is for the #2 cylinder, control proceeds to step 5 where a #2 is set in the ignition cylinder counter CYLCNT. Control then proceeds on to step 6, where an ignition signal is output to the power transistor of the #2 cylinder to cause ignition therein.

Also, when judged in step 2 that the ignition reference timing is for the #3 cylinder, control proceeds to step 7 where a #3 is set in the ignition cylinder counter CYLCNT. Control then proceeds on to step 8, where an ignition signal is output to the power transistor of the #3 cylinder for ignition therein.

As described above, when the cylinder discrimination signal CYL is being output normally, the cylinder for which the latest reference angle signal REF is the ignition reference is specified based on the number of pulses of the cylinder discrimination signal CYL output between the latest reference angle signal REF and the previous reference angle signal REF. An ignition signal with the latest reference angle signal REF as the reference timing, is then output to the power transistor of the specified cylinder. Ignition is thus carried out successively in each cylinder.

On the other hand, when judged in step 1 that cylinder discrimination is not possible due to an abnormality in the cylinder discrimination signal CYL, control proceeds to step 9.

In step 9, the ignition cylinder counter CYLCNT in which under normal operation of the cylinder discrimination signal CYL as described above, the number of the cylinder to be ignited is set each time ignition control is carried out, is increased by 1.

Then in step 10, it is judged if the ignition cylinder counter CYLCNT increased in step 9 has reached #4. When the count is up to #4, control proceeds to step 11 where the ignition cylinder counter CYLCNT is reset to 1.

In step 12, it is judged if the counter CYLCNT which has been subjected to the above increase process is #1. If CYLCNT =#1, control proceeds to step 4 where ignition of cylinder #1 is carried out based on the current reference angle signal REF.

When judged in step 12 that the counter CYLCNT is not #1, control proceeds to step 13 where the counter CYLCNT is judged to be either #2 or #3. Control then proceeds on to step 6 or step 8 depending on the judgment result, to thus ignite the #2 cylinder or the #3 cylinder respectively.

That is to say, if the cylinder discrimination signal CYL is normal, ignition is carried out in the order of #1→#2→#3. In contrast to this, since the ignition cylinder counter CYLCNT is repeatingly changed from 1→2→3→1 for each ignition, then the ignition cylinder counter CYLCNT changes in accordance with its change characteristics under normal operation, even when cylinder discrimination by the cylinder discrimination signal CYL is not possible.

For example, if after normal ignition of cylinder #2, cylinder discrimination becomes no longer possible, then for the normal ignition sequence the #3 cylinder should be ignited. Hence if the ignition cylinder counter CYLCNT is forcibly increased by "1" from "2" to "3", then the cylinder to be ignited (#3) can be specified by the number set in the ignition cylinder counter CYLCNT. Also, if after this the counter CYLCNT is sequentially changed from 1→2→3→1 with each reference angle signal REF, then even if cylinder discrimination becomes impossible in the interim, ignition control can still be carried out for each cylinder in the order under normal operation prior to cylinder discrimination becoming impossible.

In this way, even when the reference angle signal REF cannot be matched with the respective cylinder by cylinder discrimination from the cylinder discrimination signal CYL, ignition can still be carried out for each cylinder in accordance with the ignition order up until then. Hence the engine can keep running even with an abnormal cylinder discrimination signal CYL.

The above embodiment has been described in relation to a three cylinder two cycle engine, however the invention is applicable to any number of cylinders.

With the above embodiment, when some kind of abnormality occurs in the cylinder discrimination signal CYL so that accurate cylinder discrimination using the cylinder discrimination signal CYL is not possible, then ignition control of the separate cylinders is carried out as for normal conditions in accordance with the order up until the occurrence of the abnormality. However, once the engine has stopped, then even though the count value from the counter CYLCNT for the next ignition cylinder is stored, if for example the engine rotates while stopped, there is a possibility of a change in the cylinder which should be ignited first. Hence it is no longer possible to carry out expected ignition control for the separate cylinders at the time of restart.

Figure 5:
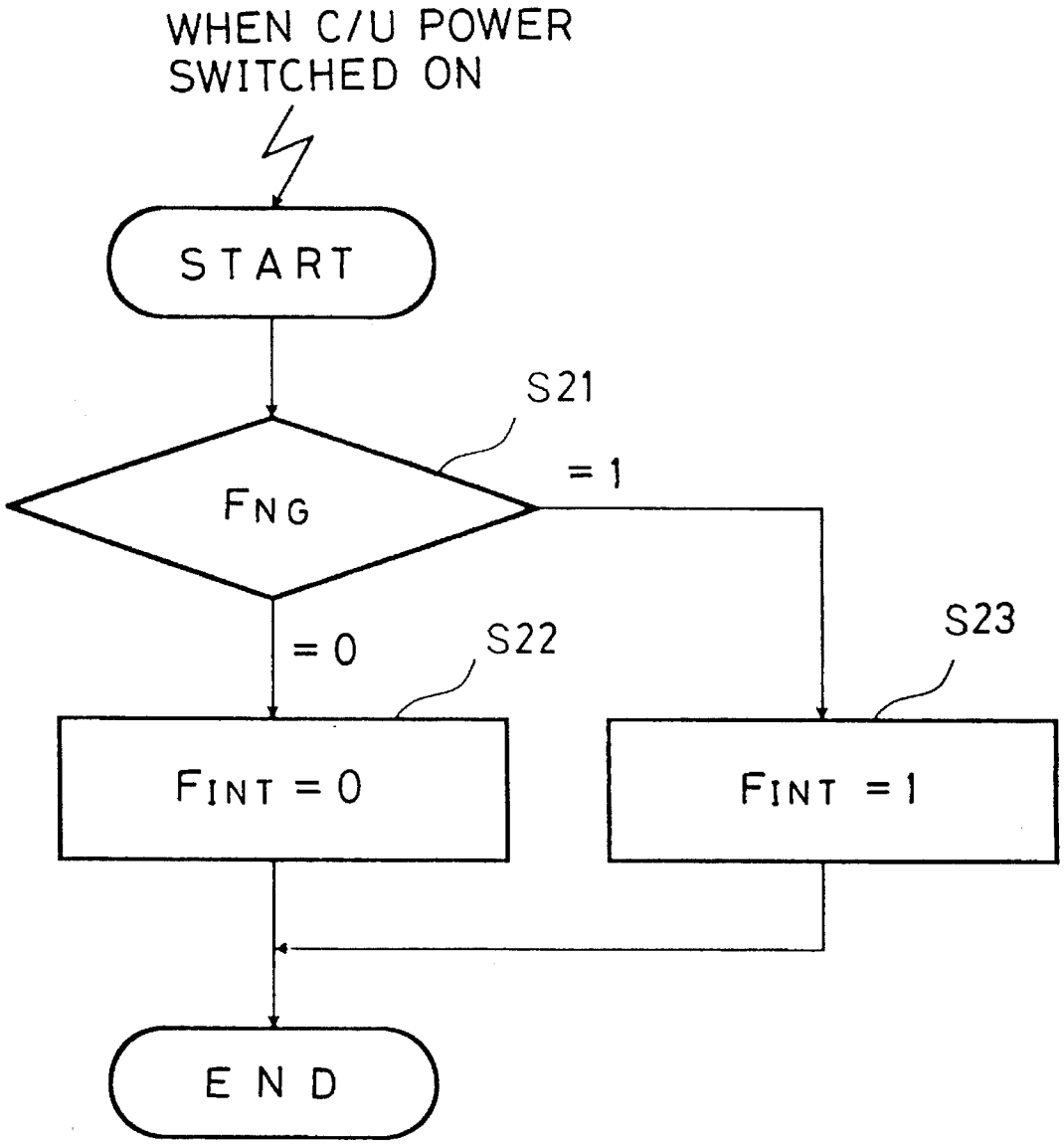
FIG. 5 is a flow chart illustrating an initial routine of a second embodiment.
Figure 6:
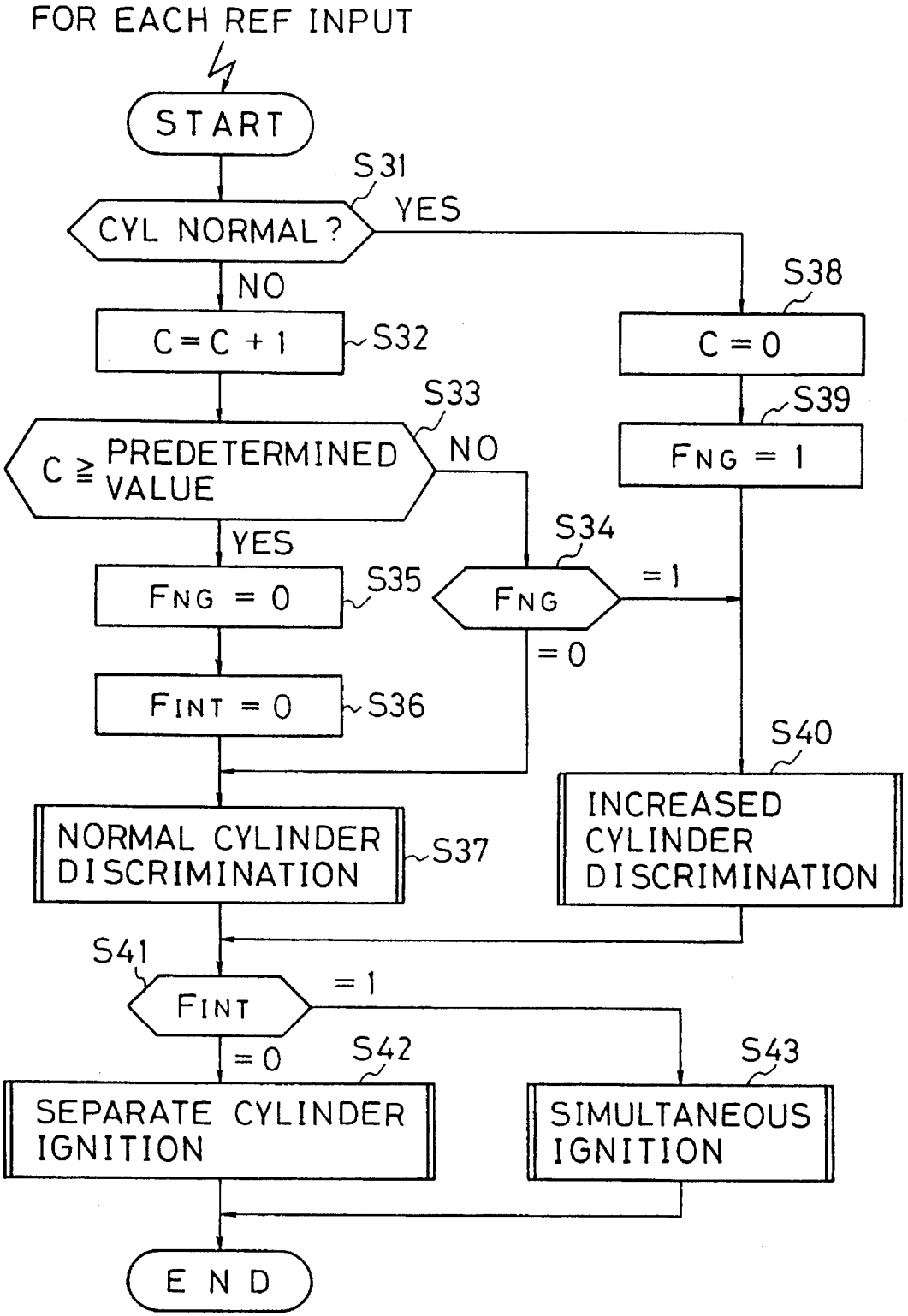
FIG. 6 is a flow chart illustrating an ignition control routine of the second embodiment.
Figure 7:
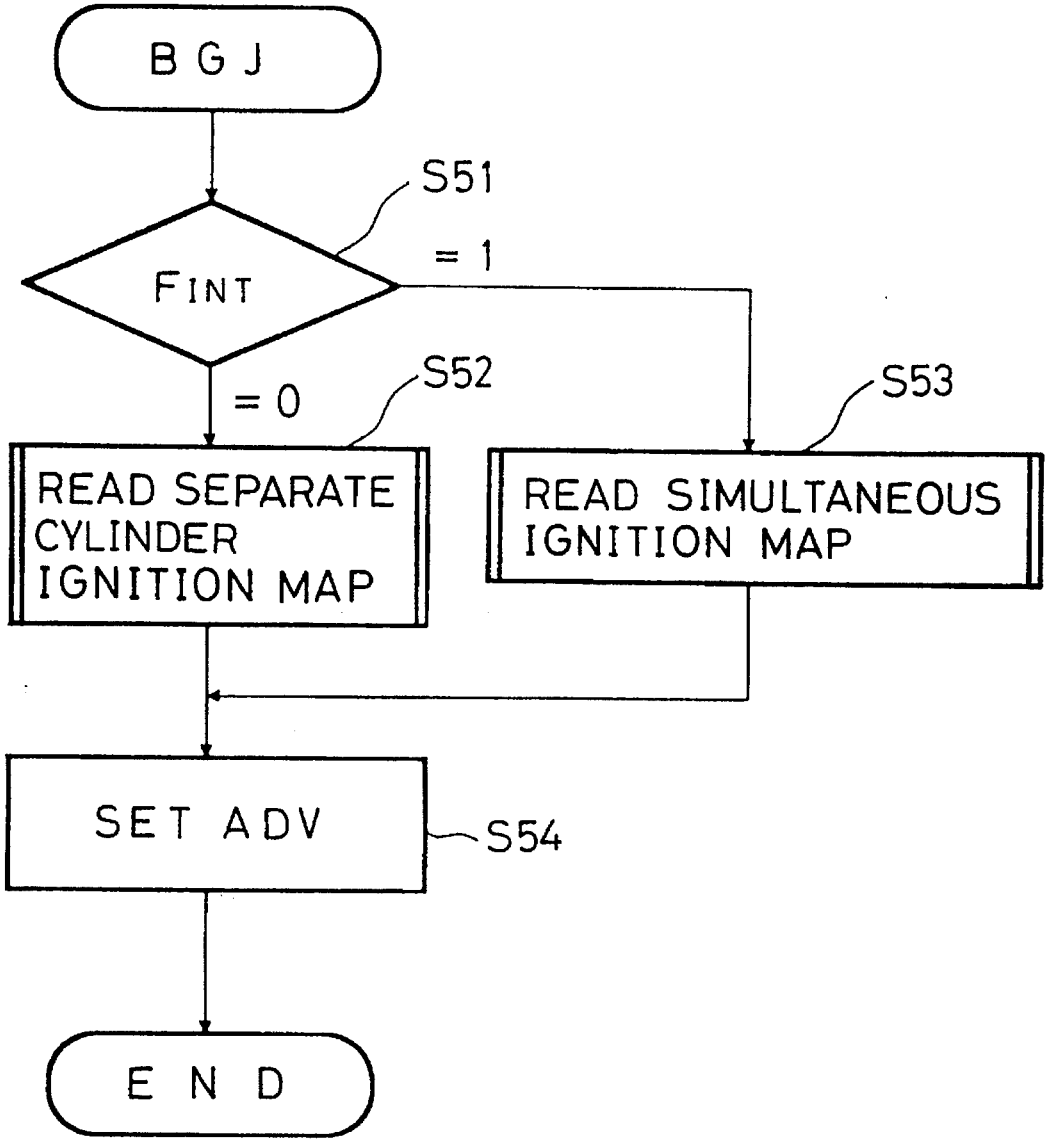
FIG. 7 is a flow chart illustrating an ignition timing computation routine of the second embodiment.

In this case, it is preferable to carry out ignition control according to a second embodiment illustrated by the flow charts of FIG. 5 through FIG. 7.

As shown by these flow charts, the functions of a diagnostic means, a fail safe means, a normal ignition control means, a diagnosis result storage device, a simultaneous ignition means, and an ignition timing limit means as shown in FIG. 1 are provided in the control unit 10. In particular, a back up RAM (not shown in the figures)is provided in the control unit 10 as a diagnosis result storage means.

The initial routine in FIG. 5 is executed when the ignition switch 15 is switched on to supply power to the control unit 10 (immediately before starting).

In step 21, the value of a backup fault diagnosis flag FNG stored in the backup RAM is read and judged if "0" or "1".

When FNG="0", control proceeds to step 22 where a simultaneous ignition flag FINT is set to "0", while when FNG="1", control proceeds to step 23 where the simultaneous ignition flag FINT is set to "1". This completes the routine.

When the cylinder discrimination signal CYL at the time of the previous operation is output normally, the value of the fault diagnosis flag FNG is "0" so that the simultaneous ignition flag FINT becomes "0".

FIG. 6 illustrates an ignition control routine which is executed for each input of a reference angle signal REF from the first crank angle sensor 31.

In step 31, diagnosis is made in a similar manner to step 1 of the first embodiment, to determine if there is an abnormality in the cylinder discrimination signal CYL output from the second crank angle sensor 32.

If the diagnosis result is for no abnormality, control proceeds to step 32 where a consecutive integer value C for a fault free condition is increased by "1". Then in the next step 33 it is judged if the consecutive integer value C is greater than or equal to a predetermined value (at least "3").

When the consecutive integer value C is less than the predetermined value, control proceeds to step 34 where the value of the backup fault diagnosis flag FNG is judged. When FNG ="0", a normal condition is assumed and control proceeds to step 37. This processing takes the initial starting time into consideration.

When the consecutive integer value C is greater than or equal to the predetermined value, conditions are diagnosed to be normal, and control proceeds to step 35 where the backup fault diagnosis flag FNG is set to "0". Control then proceeds on to step 36 where the simultaneous ignition flag FINT is set to "0", and then on to step 37. The processing of step 35 and step 36 is to restore the control from an abnormal condition to the normal condition, and has no meaning for the case where operation continues to be normal.

In step 37, normal cylinder discrimination is carried out. That is to say, the ignition cylinder is discriminated on the basis of the number of pulses of the cylinder discrimination signal CYL occurring between the immediately prior reference angle signals REF - REF. More specifically, as illustrated in FIG. 4, when the number of pulses is "1" cylinder #1 is discriminated, when the number of pulses is "0" cylinder #2 is discriminated and when the number of pulses is "3" cylinder #3 is discriminated.

After discriminating the ignition cylinder, control proceeds to step 41 where the value of the simultaneous ignition flag FINT is judged. When FINT="0", control proceeds to step 42 for separate cylinder ignition. When FINT="1", control proceeds to step 43 for simultaneous ignition.

Here, when the cylinder discrimination signal CYL at the time of the previous operation is output normally, then since the simultaneous ignition flag FINT is "0" due to execution of the initial routine of FIG. 5 on switching on the power before starting, control proceeds to step 42 for separate cylinder ignition.

In the case of separate cylinder ignition, ignition is only carried out in the discriminated cylinder, with the ignition timing ADV measured with reference to the reference angle signal REF.

More specifically, the power transistor for the ignition cylinder is switched on at the same time as input of the reference angle signal REF, to start power supply to the ignition coil 18, and timing is started. The crank angle is then computed from the predetermined pre-TDC crank angle position wherein the reference angle signal REF is generated, to the ignition timing ADV. This crank angle is converted to a time value using the time period between the reference angle signals REF - REF. When this time value has elapsed from the start of the timing, the power transistor of the ignition cylinder is switched off, thus shutting off power to the ignition coil 18 to ignite the ignition cylinder by means of the spark plug 14.

As follows is a description of a case wherein an abnormality occurs in the cylinder discrimination signal CYL during operation.

When in step 31 the diagnosis result for the cylinder discrimination signal CYL shows an abnormality, control proceeds to step 38 and the consecutive integer value C for the fault free condition is reset to "0".

Control then proceeds to step 39 where the backup fault diagnosis flag FNG is set to "1". The data of the backup fault diagnosis flag FNG is written into the backup RAM.

Control then proceeds to step 40 where cylinder discrimination using the ignition cylinder counter CYLCNT is carried out as previously described according to the flow chart of FIG. 3.

After ignition cylinder discrimination, control proceeds to step 41 where the value of the simultaneous ignition flag FINT is judged. When FINT="0" control proceeds to step 42 for separate cylinder ignition. When FINT="1", control proceeds to step 43 for simultaneous ignition.

Here, when the cylinder discrimination signal CYL at the time of the previous operation is output normally, then since the simultaneous ignition flag FINT is "0" due to execution of the initial routine of FIG. 5 on switching on the power before starting, control proceeds to step 42 for separate cylinder ignition. That is to say, ignition is only carried out in the discriminated cylinder, with the ignition timing ADV measured with reference to the reference angle signal REF.

Moreover, notwithstanding that there may be a temporary abnormality in the cylinder discrimination signal CYL during operation, once recovered and subsequently diagnosed in step 31 to have no abnormality, then while the consecutive integer value C for the fault free condition is still less than the predetermined value, control proceeds to step 40 by way of steps 33, and 34, and cylinder discrimination using the ignition cylinder counter CYLCNT continues. When the consecutive integer value C for the fault free condition becomes equal to or greater than the predetermined value, the normal condition is diagnosed. Consequently in step 35 the backup fault diagnosis flag FNG is rewritten as "0", and in step 37 control is switched to the normal cylinder discrimination using the cylinder discrimination signal CYL.

As follows is a description of a case wherein the engine is restarted with the cylinder discrimination signal CYL in an abnormal condition, after switching off the ignition switch 15 to stop the engine.

In this case, the data for the backup fault diagnosis flag FNG="1" stored in the backup RAM at the time when operation ceases, is retained in memory even after the engine stops. With execution of the initial routine of FIG. 5 when the power is switched on before starting the engine, since in the judgement of step 21 FNG="1", control proceeds to step 23 where the simultaneous ignition flag FINT is set to "1".

Consequently, after execution of steps 31–40 in the ignition control routine of FIG. 6 for each input of the reference angle signal REF, then in step 41 since FINT="1", control proceeds to step 43 for simultaneous ignition.

In the case of simultaneous ignition, ignition is carried out simultaneously in all cylinders (cylinder #1 through cylinder #3 ) with the ignition timing ADV measured with reference to the reference angle signal REF.

More specifically, the power transistors for all of the cylinders are switched on at the same time as input of the reference angle signal REF, to start power supply to the ignition coils 18 for all the cylinders, and timing is started. The crank angle is then computed from the predetermined pre-TDC crank angle position wherein the reference angle signal REF is generated, to the ignition timing ADV. This crank angle is converted to a time value using the time period between the reference angle signals REF - REF. When this time value has elapsed from the start of the timing, the power transistors for all of the cylinders are switched off, thus shutting off the power to the ignition coils 18 to thus ignite the spark plugs 14 in all the cylinders.

Hence even if cylinder discrimination is terminated in failure, starting is still possible. Moreover, with recovery of the cylinder discrimination signal CYL after starting, then when diagnosed in step 31 to have no abnormality, when the consecutive integer value C for the fault free condition becomes greater than or equal to a predetermined value, conditions are diagnosed to be normal. Consequently, since in step 36, the simultaneous ignition flag FINT becomes "0", then from the judgment of step 41, control proceeds to step 42 and control changes to that for separate cylinder ignition.

FIG. 7 illustrates a background job routine for computing ignition timing ADV.

The ignition timing ADV is determined by referring to maps on the basis of engine operating conditions (more specifically, the engine rotational speed N and basic fuel injection amount Tp). These maps are provided for separate cylinder ignition and for simultaneous ignition. In step 51 when the value of the simultaneous ignition flag FINT is judged to be "0", then in step 52 the ignition timing ADV is read from the map for separate cylinder ignition, while when judged to be "1", then in step 53 the ignition timing ADV is read from the map for simultaneous ignition. Then in step 54, the ignition timing ADV is set in a predetermined register.

This is done so that the ignition timing advance setting at the time of simultaneous ignition is limited compared to that at the time of separate cylinder ignition, so as to prevent any detrimental influence resulting from ignition in cylinders other than the cylinder to be ignited, due for example to high speed rotation.

What is claimed is:

1. An apparatus for controlling an ignition of a multi-cylinder two cycle engine, said apparatus comprising:

reference angle signal output means for outputting a reference angle signal for each predetermined crank angle position, said reference angle signal providing a reference for ignition control of each cylinder, cylinder discrimination signal output means for outputting a cylinder discrimination signal for matching the reference angle signal with the respective cylinders, diagnostic means for judging a normal or abnormal condition of said cylinder discrimination signal output means, normal ignition control means for, when the normal condition of said cylinder discrimination signal output means is judged by said diagnostic means, matching the reference angle signal with the respective cylinders on the basis of the cylinder discrimination signal, measuring an ignition timing with reference to the reference angle signal, and then carrying out the ignition in the respective cylinders, and fail safe means for, when the abnormal condition of the cylinder discrimination signal output means is judged by said diagnostic means, stopping the operation of the normal ignition control means, matching the reference angle signal with the respective cylinders in the order in which it was matched under the normal condition up until the occurrence of the abnormal condition, measuring the ignition timing with reference to the reference angle signal, and then carrying out the ignition in the respective cylinders.

2. An apparatus for controlling the ignition of a multi-cylinder two cycle engine as claimed in claim 1, wherein said fail safe means includes a counter having a counter value which is increased to a predetermined value on the basis of the cylinder discrimination result when a normal condition is judged by said diagnostic means, and after the abnormal condition is diagnosed by said diagnostic means, said fail safe means increases the counter value for each generation of the reference angle signal, and carries out cylinder discrimination based on the counter value.

3. An apparatus for controlling the ignition of a multi-cylinder two cycle engine as claimed in claim 1, wherein said cylinder discrimination signal output means denotes the cylinder number by a number of pulses generated at a interval of generation of said reference angle signals.

4. An apparatus for controlling the ignition of a multi-cylinder two cycle engine as claimed in claim 1, wherein said diagnostic means judges a normal or abnormal condition of said cylinder discrimination signal output means on the basis of a comparison between the latest and previous cylinder discrimination results from the cylinder discrimination signal.

5. An apparatus for controlling the ignition of a multi-cylinder two cycle engine as claimed in claim 1, further comprising:

diagnostic result storage means for storing the latest diagnostic result of the diagnostic means even after the engine stops, and simultaneous ignition means for reading, immediately before starting the engine, the diagnostic result stored in the diagnostic result storage means, and when the result is abnormal, for stopping the operation of the normal ignition control means and the fail safe means, and for measuring the ignition timing with reference to the reference angle signal, and for carrying out the ignition simultaneously in all cylinders.

6. An apparatus for controlling the ignition of a multi-cylinder two cycle engine as claimed in claim 5, comprising an ignition timing limit means for limiting ignition timing advance control under said simultaneous ignition means, compared to a range of the ignition timing advance control under the normal ignition control means and fail safe ignition control means.

7. A method for controlling an ignition of a multi-cylinder two cycle engine, said method comprising the steps of:

outputting a reference angle signal for each predetermined crank angle position, said reference angle signal providing a reference for ignition control of each cylinder, and outputting a cylinder discrimination signal for matching the reference angle signal with the respective cylinders, wherein when a condition of the cylinder discrimination signal is judged to be normal, the reference angle signal is matched with the respective cylinders on the basis of the cylinder discrimination signal, the ignition timing is measured with reference to the reference angle signal, and the ignition is carried out in the respective separate cylinders, and when a condition of the cylinder discrimination signal is judged to be abnormal, the referenced angle signal is matched with the respective cylinders in the order in which it was matched under the normal condition up until the occurrence of the abnormal condition, an ignition timing is measured with reference to the reference angle signal, and the ignition is carried out in the respective cylinders.

8. A method for controlling the ignition of a multi-cylinder two cycle engine as claimed in claim 7, wherein a counter has a counter value which is increased to a predetermined value on the basis of the cylinder discrimination result when the condition of said cylinder discrimination signal is judged to be normal, and which is increased for each generation of the reference angle signal when the condition of said cylinder discrimination signal is judged to be abnormal, and cylinder discrimination is carried out based on the counter value.

9. A method for controlling the ignition of a multi-cylinder two cycle engine as claimed in claim 7, wherein said cylinder discrimination signal denotes the cylinder number by a number of pulses generated at a interval of generation of said reference angle signals.

10. A method for controlling the ignition of a multi-cylinder two cycle engine as claimed in claim 7, wherein the normal or abnormal condition of said cylinder discrimination signal is judged on the basis of a comparison between the latest and previous cylinder discrimination results provided by the cylinder discrimination signal.

11. A method for controlling the ignition of a multi-cylinder two cycle engine as claimed in claim 7, wherein the latest discrimination results for normal or abnormal conditions of the cylinder discrimination signal are stored even after the engine stops, and when the discrimination results read immediately before starting the engine are abnormal, the ignition timing is measured with reference to the reference angle signal, and the ignition is carried out simultaneously in all cylinders.

12. A method for controlling the ignition of a multi-cylinder two cycle engine as claimed in claim 11, wherein an ignition timing advance control at the time of the simultaneous ignition in all cylinders is limited, compared to that for a range of the ignition timing advance control at the time of the ignition in the respective cylinders.

* * * * *